US009564682B2

(12) United States Patent
Rhoads et al.

(10) Patent No.: US 9,564,682 B2
(45) Date of Patent: Feb. 7, 2017

(54) BODY-WORN PHASED-ARRAY ANTENNA

(71) Applicant: Digimarc Corporation, Beaverton, OR (US)

(72) Inventors: Geoffrey B. Rhoads, West Linn, OR (US); Hugh L. Brunk, Portland, OR (US)

(73) Assignee: Digimarc Corporation, Beaverton, OR (US)

( * ) Notice: Subject to any disclaimer, the term of this patent is extended or adjusted under 35 U.S.C. 154(b) by 434 days.

(21) Appl. No.: 13/939,465

(22) Filed: Jul. 11, 2013

(65) Prior Publication Data

US 2014/0159959 A1 Jun. 12, 2014

Related U.S. Application Data

(60) Provisional application No. 61/670,568, filed on Jul. 11, 2012.

(51) Int. Cl.
*H01Q 3/22* (2006.01)
*H01Q 3/26* (2006.01)
(Continued)

(52) U.S. Cl.
CPC ..... *H01Q 3/2682* (2013.01); *H01Q 1/273* (2013.01); *H01Q 3/34* (2013.01)

(58) Field of Classification Search
CPC ..... H01Q 3/22; H01Q 3/2682; H01Q 1/273; H01Q 3/34
(Continued)

(56) References Cited

U.S. PATENT DOCUMENTS 6,377,216 B1 4/2002 Cheadle et al.
6,771,224 B2 8/2004 Apostolos
(Continued)

FOREIGN PATENT DOCUMENTS

CN 101325529 A * 12/2008

OTHER PUBLICATIONS

Woo Cheol Chung etc, 2004, VTVT (Virginia Tech VLSI for Telecommunications) Laboratory, Abstract.*
(Continued)

*Primary Examiner* — Harry Liu
(74) *Attorney, Agent, or Firm* — Digimarc Corporation

(57) ABSTRACT

Several (in some cases many dozen) small antennae are integrated into or over a full body suit or clothing. These antennae preferably include an intra-suit or clothing wired connection to one or more small Ultra-Wide-Band (UWB) radios, e.g., in the 3-10 GHz range. In some cases, each antenna connection includes a variable delay, e.g., a few nanoseconds with picoseconds-scale resolution on the delays, thus allowing for the body-suit ensemble to act as a directional phased-array. One claim recites a radio wearable by a human comprising: a phased-array antenna including a plurality of antennae, the array being configured for wearing over or on a human body, the plurality of antennae provided for spatially positioning in multiple different regions over or on the human body; an RF radio; and a controller configured for: i) determining relative spatial position information for antennae within the phased-array antenna; and ii) using at least the relative spatial position information, controlling the radio to produce a directional UWB beam through the phased-array antenna. Another claim includes an antenna having a plurality of metamaterial elements. Of course, other claims and combinations are provided as well.

24 Claims, 5 Drawing Sheets

(51) Int. Cl.
*H01Q 1/27* (2006.01)
*H01Q 3/34* (2006.01)

(58) Field of Classification Search
USPC ..... 342/375; 343/718
See application file for complete search history.

(56) References Cited

U.S. PATENT DOCUMENTS 6,859,114 B2 2/2005 Eleftheriades et al.
6,958,729 B1 10/2005 Metz
6,972,725 B1 * 12/2005 Adams ..... H01Q 1/273 343/718
7,299,070 B2 11/2007 Karaoguz et al.
7,440,777 B2 10/2008 Karaoguz et al.
7,450,077 B2 11/2008 Waterhouse et al.
7,522,124 B2 4/2009 Smith et al.
7,538,946 B2 5/2009 Smith et al.
7,616,112 B2 11/2009 Miller, III
7,629,934 B2 12/2009 Rhodes et al.
7,642,963 B2 1/2010 Apostolos et al.
7,710,664 B2 5/2010 Bowers et al.
7,764,232 B2 7/2010 Achour et al.
7,855,696 B2 12/2010 Gummalla et al.
7,872,812 B2 1/2011 Bowers et al.
7,958,713 B2 6/2011 Stobbe
8,081,138 B2 12/2011 Wu et al.
8,164,837 B2 4/2012 Bowers et al.
8,207,907 B2 6/2012 Hyde et al.
8,384,600 B2 2/2013 Huang et al.
8,451,183 B2 5/2013 Penev et al.
8,462,063 B2 6/2013 Gummalla et al.
9,136,931 B2 9/2015 Shattil
9,213,874 B2 12/2015 Burnside
2004/0004573 A1 * 1/2004 Apostolos ..... H01Q 11/14 343/718
2005/0020918 A1 * 1/2005 Wilk ..... A61B 5/6804 600/439
2005/0232208 A1 10/2005 Hansen
2006/0058606 A1 * 3/2006 Davis ..... A61B 5/05 600/407
2006/0121946 A1 6/2006 Walton et al.
2008/0191950 A1 * 8/2008 Chang ..... H01Q 1/276 343/718
2008/0252524 A1 * 10/2008 Chu ..... H01Q 3/2682 342/375
2011/0025521 A1 * 2/2011 Gurton ..... F41H 11/00 340/686.1
2011/0031928 A1 * 2/2011 Soar ..... F41G 1/34 320/108
2011/0148581 A1 * 6/2011 Chamseddine ..... G06K 7/0008 340/10.1
2012/0007772 A1 * 1/2012 Parssinen ..... G06F 3/013 342/176
2012/0029345 A1 * 2/2012 Mahfouz ..... A61B 5/1036 600/427
2012/0119933 A1 * 5/2012 Manela ..... G01S 7/38 342/14
2013/0242283 A1 * 9/2013 Bailey ..... G01S 17/89 356/4.01

OTHER PUBLICATIONS

U.S. Appl. No. 61/670,568, filed Jul. 11, 2012 (priority document for the present application).
Braaten et al., "A Metamaterial-Based Series Connected Rectangular Patch Antenna Array for UHF RFID Readers," 6$^{th}$ European Conference on Antennas and Propagation, IEEE, 2011, pp. 3164-3167.
Braaten, et. al., "Phase-Compensated Conformal Antennas for Changing Spherical Surfaces," IEEE Transactions on Antennas and Propagation, vol. 62, No. 4, Apr. 2014, pp. 1880-1887.
Cotton et al., "Millimeter-Wave Soldier-to-Soldier Communications for Covert Battlefield Operations," IEEE Communications Magazine, Oct. 2009, pp. 72-81.
Cheng et al., "Sidelobe-Reduction Techniques for Phased Arrays Using Digital Phase Shifters," IEEE Transactions on Antennas and Propagation, vol. AP-18, No. 6, Nov. 1970.
Islam et al., "A 900 MHz Beam Steering Parasitic Antenna Array for Wearable Wireless Applications," IEEE Transactions on Antennas and Propagation, vol. 61, No. 9, Sep. 2013, pp. 4520-4527.
Kennedy et al., "Body-Worn E-Textile Antennas: The Good, the Low-Mass, and the Conformal," IEEE Transactions on Antennas and Propagation, vol. 57, No. 4, Apr. 2009, pp. 910-918.
Lee, et al., "Omnidirectional Vest-Mounted Body-Worn Antenna System for UHF Operation," IEEE Antennas and Wireless Propagation Letters, vol. 10, 2011, pp. 581-583.
D. Psychoudakis et al., "Body-Worn Diversity Antennas for Squad Area Networks (SAN)," 2008 URSI General Assembly, Chicago, IL.
Sayan Roy, "Designing of a Small Wearable Conformal Phased Array Antenna for Wireless Communications," A Thesis Submitted to the Graduate Faculty of the North Dakota State University of Agriculture and Applied Science, Aug. 2012 (76 pages).
Scarpello et al., "High-Gain Textile Antenna Array System for Off-Body Communication," International Journal of Antennas and Propagation, vol. 2012, Article ID 573438, 12 pages, (Received Sep. 20, 2011; Revised Mar. 8, 2012; Accepted Mar. 8, 2012).
Yang, et al., "Wearable Ultra-Wideband Half Disk Antennas," IEEE, 2005, pp. 500-503.

* cited by examiner

BODY-WORN PHASED-ARRAY ANTENNA

This application claims the benefit of U.S. Provisional Application No. 61/670,568, filed Jul. 11, 2012, which is hereby incorporated herein by reference.

TECHNICAL FIELD

The present disclosure relates generally to the field of wireless communications. In some embodiments the disclosure relates more particularly to phased-array antenna systems. In still further embodiments the disclosure relates to body-wearable phased-array antenna systems. Such systems find used, e.g., for first responders (e.g., fire fighters, medical personal), law enforcement and military personnel.

SUMMARY

This disclosure relates to person to person RF (radio frequency) packet communications, most typically using UWB (ultra-wide band), and Wi-Fi or cell protocols of various flavors. Streams of such packets are more and more replacing traditional 'continuous channel' forms of radios such as the classic walkie-talkies. The principle of this invention works for continuous channels as well, but it is in packet-based communications where the jam resistance and low probability of detection properties shine more brightly.

Others have dabbled in this general ballpark. The company Wearable Antenna Technologies Inc. in Gallatin, Tenn., USA, claims to have developed a Tactical Vest Antenna System that is a concealable antenna designed for military applications. The radiating elements slide over small arms protective insert plates inside a plate carrier, placing a whip antenna out of enemy's sight, and out of the radio operator's way. The antenna system consists of two antenna inserts, two interconnecting cables, and a cable for radio connection. The radio operates in the 30-512 MHz range and provides an omnidirectional radiation pattern.

Pharad, LLC in Glen Burnie, Md., USA, claims to offer a wearable UWB (ultra wide band) antenna. This body wearable antenna is fabricated using a thin flexible material for placement next to the exterior of body armor or tactical vests. UWB link performance is maintained supposedly without hindering the user's vision or movement. A SMA connector allows these antennas to connect to standard radios. This antenna operates in the 3-10 GHz range and provides a near omni-directional pattern.

Other body-wearable antennae examples are found in U.S. Pat. Nos. 7,450,077; 7,629,934; and 7,642,963, which are each hereby incorporated herein by reference in their entirety. Several publications also address this space, e.g., Lee, et al., "Omnidirectional Vest-Mounted Body-Worn Antenna System for UHF Operation," IEEE ANTENNAS AND WIRELESS PROPAGATION LETTERS, VOL. 10, 2011, pg. 581-583; "Yang, et al., "Wearable Ultra-Wideband Half Disk Antennas," IEEE, 2005, pp. 500-503; and D. Psychoudakis, "Body-Worn Diversity Antennas for Squad Area Networks (SAN)," 2008 URSI General Assembly, Chicago, Ill., each of which is hereby incorporated herein by reference in its entirety.

What we do not see in these prior works is a body-worn phased-array antenna in the manner described in this patent document. Other features and advantages discussed herein are also missing.

As a brief summary, several (in some cases many dozen) small antennae are integrated into, over and/or throughout a full body suit or clothing. These antennae preferably include an intra-suit or clothing wired connection to one or more small Ultra-Wide-Band (UWB) radios, e.g., in the 3-10 GHz range, or controllers associated with the radios. In some cases, each antenna connection includes a variable (sometimes selectable) delay, e.g., a few nanoseconds with picoseconds-scale resolution on the delays, thus allowing for the body-suit ensemble to act as a directional phased-array. Two or more such suits can combine to create a high reliability, low probability of intercept and nearly jam-proof network between people wearing such directional phased-array systems. Features of these include narrow focused beams—preferably not omni-directional—and low power level and sparse packet rates.

Active phasing of cooperative antennae can 'beam' RF energy in specific directions. E.g., an example of a directional beam transmission is shown in FIG. 4. Aspects of this disclosure present pragmatic approaches to treating the body and limbs of a person as a phased array antenna. There are a variety of novelties to make this approach function, including, e.g., dealing with the rapid and ever-changing configuration of the human body in motion, especially in extreme forms of motion and position. In order to phase the sub-antennae draped around a person's body correctly, one preferably knows how those antennae spatially relate to each other generally, e.g., at the tenth-of-a-second time scale or even finer. Approaches are presented which can do this to, generally, centimeter and sub-centimeter precision. When one considers standard communications frequency bands in the GHz and even greater than 10 GHz ranges, such spatial knowledge can be fundamental to proper phasing. The actual phasing of the signals then proceeds on the order of low double-digit picoseconds in delay-control or even finer.

The foregoing and other features, aspects and advantages of the present technology will be even more readily apparent from the following detailed description, which proceeds with reference to the accompanying drawings.

DETAILED DESCRIPTION

An efficient and non-burdensome way to directly send an RF packet from one person to another is to treat their entire bodies as an antenna array. One way to accomplish this is to augment their clothing, suit, vest or uniform with micro-antennae—preferably over a majority of their body region—and treat the whole body as a tuned phased array. Phased arrays have long been known to be a preferred way to 'beam' RF energy from one specific point to another, in a directional manner.

Figure 1:
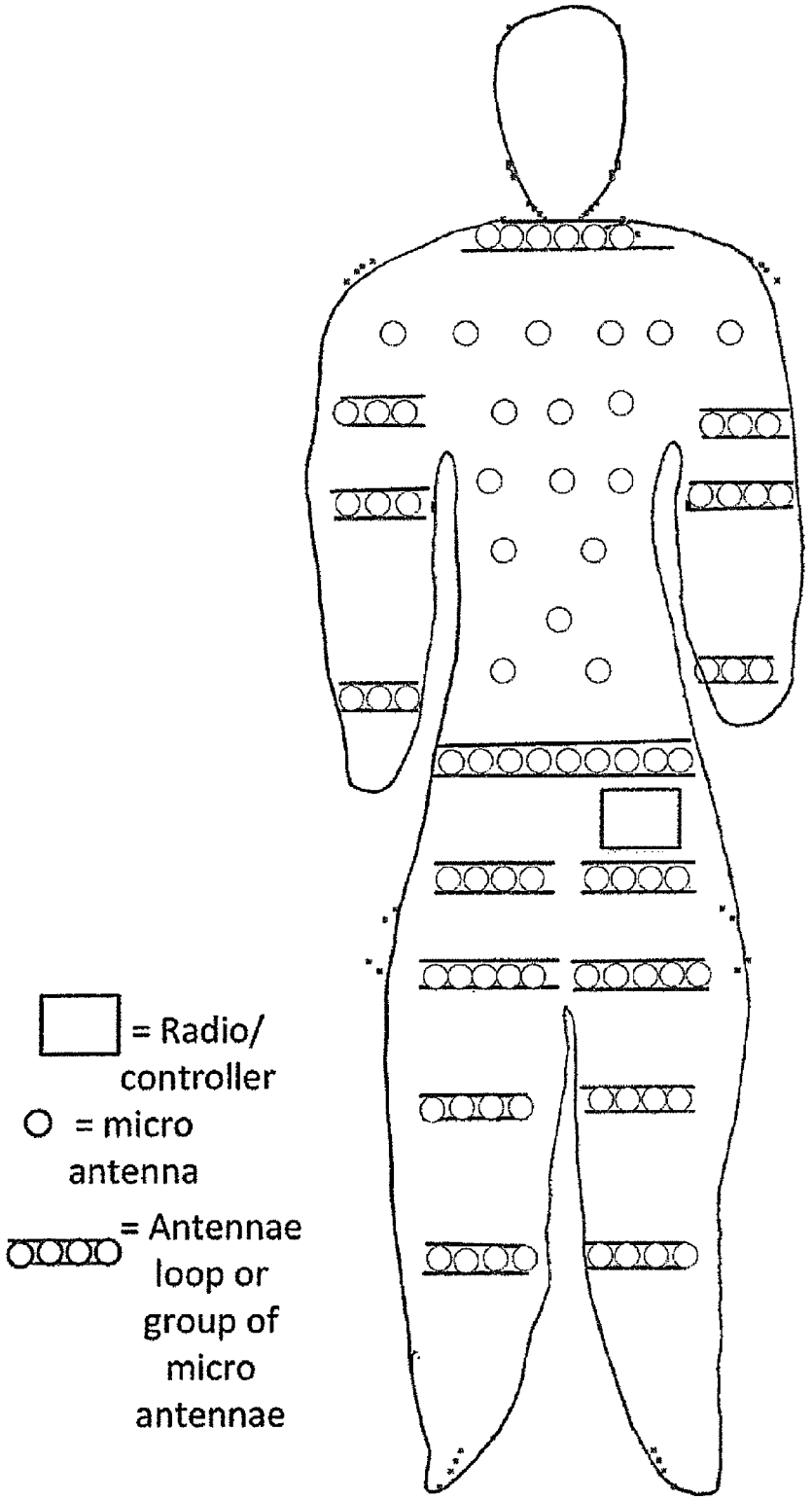
FIG. 1 illustrates a wearable antennae array system.

With reference to FIG. 1, a wearable antennae array system is illustrated. The array includes a plurality of antenna arranged over the body, e.g., as integrated into or carried by clothing worn by a human. The array preferably includes a plurality of micro-antenna arranged over the body. The micro antennae can be grouped or arranged in loops (e.g., around the legs, arms, neck, etc.) or variously placed (e.g., torso) to help achieve a phased-array. The system includes one or more RF radios. The radio may be constructed from various hardware components (e.g., mixers, RF front end, filters, amplifiers, modulator/demodulators, detectors, transceivers, etc.) or be constructed as a so-called "software-define radio" (SDR) in which many of the traditional hardware components are provided in software or embedded computing devices, in connection with various amplifiers. Of course, the radio can include both hardware and software components. SDR's have some advantages including allowing designers to forgo limited assumptions associated with traditional hardware. For example, using an SDR for ultra wideband techniques allow several transmitters to transmit in the same place on the same frequency with very little interference, typically combined with one or more error detection and correction techniques to fix all the errors caused by such interference. Regardless of the implementation, the system radio preferably operates in the 3-10 GHz range. Of course, other frequency ranges will similarly benefit from the inventive techniques disclosed herein.

The micro-antennae themselves can be constructed with thin (e.g., think smaller than human hair) and lightweight wiring. In some cased nanoantenna technology could be used.

Figure 2:
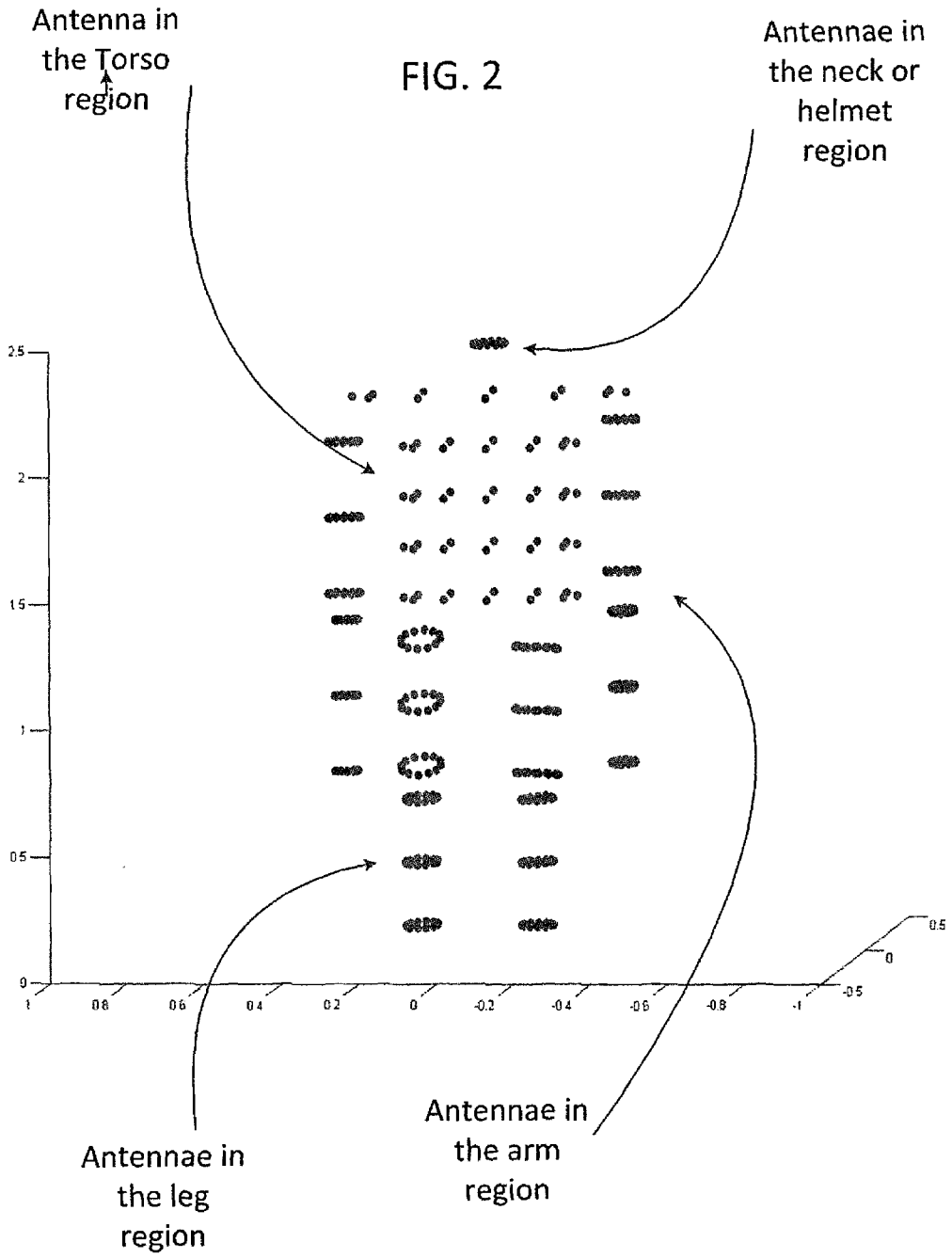
FIG. 2 illustrates a wearable phased-array system with a human outline removed.

FIG. 2 illustrates a wearable phased-array system with the human outline removed. The x, y & z axis are in meters.

The radio includes or cooperates with a controller. The controller can be constructed with hardware, programmed microprocessors and/or specialized integrated circuits (ICs), e.g., digital signal processors (DSPs). The controller may include or cooperate with an IC delay unit. The controller is preferably in communication with each micro antenna and/or with groups of antennae. For example, the controller communicates with the micro-antennae over wired lines or via a low power wireless connection.

In some examples the controller facilitates: 1) determining and maintaining knowledge of relative body positions, e.g., arm to leg or arm to torso, etc. (and, hence, relative antennae positions)—helping to, 2) 'picophase' signals going out to all the transmission points (micro antennae) on the body such that the system's combined RF transmission signal becomes a highly directional beam aimed toward some receiving person. The person receiving such beamed RF packets can also 'tune' their reception in a similar phased-array manner, increasing the overall energy efficiency of the established communications, making those communications approach the limits of jam resistance and improbability of detection.

Let's take these above operations, 1 & 2, in turn.

First, determining and maintaining relative antennae positioning across the body is helpful in order to properly time signal phase and amplitude transmission across the wearable phased-array antenna. A phased-array antennae system typically includes a plurality of radiating elements (in our case, micro antennae, or in some cases groups of micro-antennae). Beams can be formed by shifting the phase and/or amplitude of the signal emitted from each radiating element, to provide constructive/destructive interference so as to steer the beams in a desired direction.

There are several ways to determine relative antenna positioning.

For example, the controller can cause a micro-antenna, e.g., positioned over the left leg, to transmit a lower frequency signal or "chirp" (e.g., 100 MHz). The controller can monitor the receipt of the chirp at each micro antenna across the system (or at select antenna in each antenna loop or group across the system). Reception timing at different micro antennae will allow for the calculation of relative distances between the chirping antenna and the receiving antennae. (Of course, the system can be calibrated to take into account line transmission delays from the controller across various system circuitry and communication lines to each of the micro-antennae and/or groups of antennae. This delay time in connection with chirp signal reception timing can allow for precise relative distance calculations based on time of flight/transmission.) Calculated distances for each node relative to other nodes or group of nodes can be stored for use when sending out phase transmission signals and appropriate delays. This is an efficient approach since, e.g., 30 loops (of 12 micro-antennae each) can be chirped in less than 1 ms. Timing of the chirps can be controlled to help conserve battery consumption. For example, the system will exercise a complete antennae chirp process at predetermined intervals, or when the system senses system movement or partial movement (e.g., input from one or more gyroscopes and/or accelerometers).

Each micro-antenna may include both a transmitter and receiver, with the receiver monitoring chirps and other communication. Time multiplex arrangements can also be used to transition a transceiver between transmit and receive modes.

Of course, other techniques (e.g., from the near field communications field) can be used to help determine relative antennae positioning.

Returning to the second operation—picophasing—the controller controls signaling to the various transmission points (micro antennae) over the body such that the system's combined RF transmission signal becomes a highly directional beam aimed toward some receiving station or person. A receiver can also 'tune' their reception in a similar phased-array manner, increasing the overall energy efficiency of the established communications, making those communications approach the limits of jam resistance and improbability of detection.

One approach delays signals to corresponding micro-antennae by fixed amounts corresponding to roughly where on the body they are spatially located (mid-thigh, for example), then further pico-delayed by a value determined by the direction from the body the overall beam dictates. Think '1 o'clock forward', which then translates into micro-antennae in the back part of the thigh pulsing just slightly ahead of those on the forward part of the thigh, together forming a beam heading in the selected 1 o'clock direction. On reception, this active picophasing can occur either in the physical domain of tuned delay lines OR in the digital signal processing realm of individually recorded waveforms of the micro-antennae.

As mentioned above the controller can include or cooperate with a delay circuit. The delay circuit may include, e.g., a tapped delay circuit in which differing delay paths/times can be selected based on different circuit taps. For example, the circuit may provide signal delays in a range of 50 picoseconds (ps) to 550 ps in 1 ps or more increments. Of course other delay paths with different ranges can be used to help provide appropriate timing. Knowing the relative spatial antennae alignment and the inherent system transmission delays, the controller can select an appropriate delay when sending an RF signal for each of the various micro-antennae or for groups (or loops) of antennae. Thus, the controller provides picophasing to operate the wearable antennae system to operate as a phased-array providing a highly directional beam.

Figure 3:
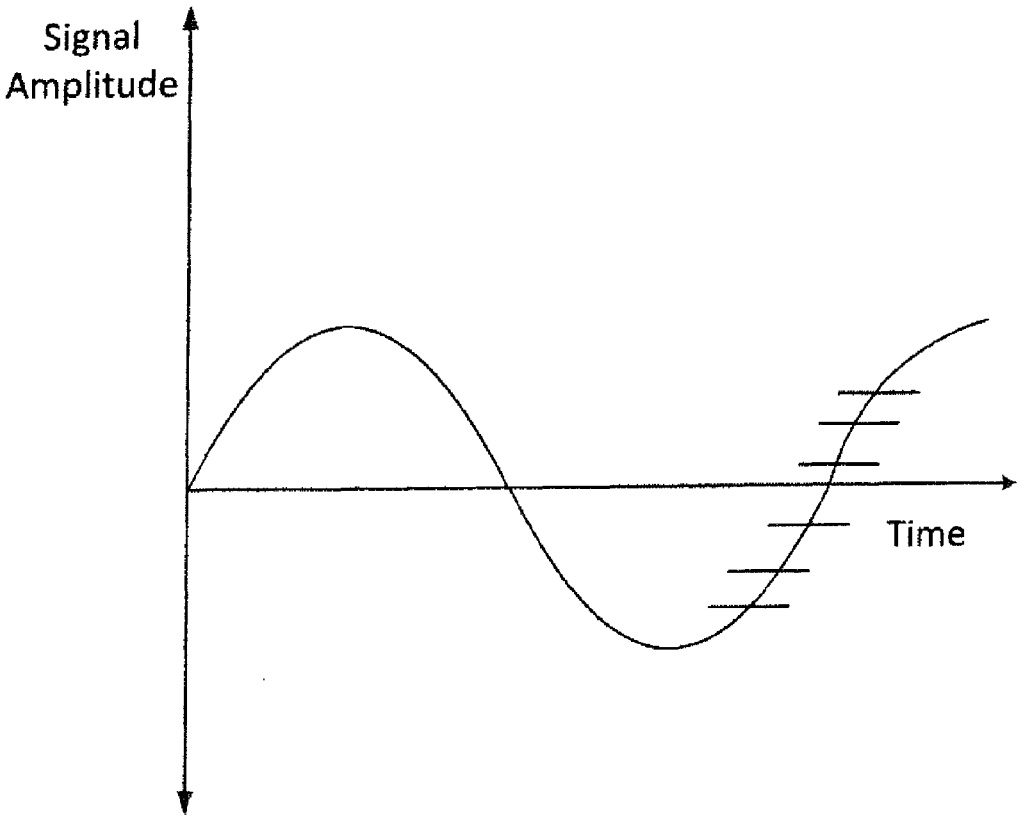
FIG. 3 shows that micro antennae or loops of antennae can be configured to transmit at different signal amplitude levels.
Figure 4:
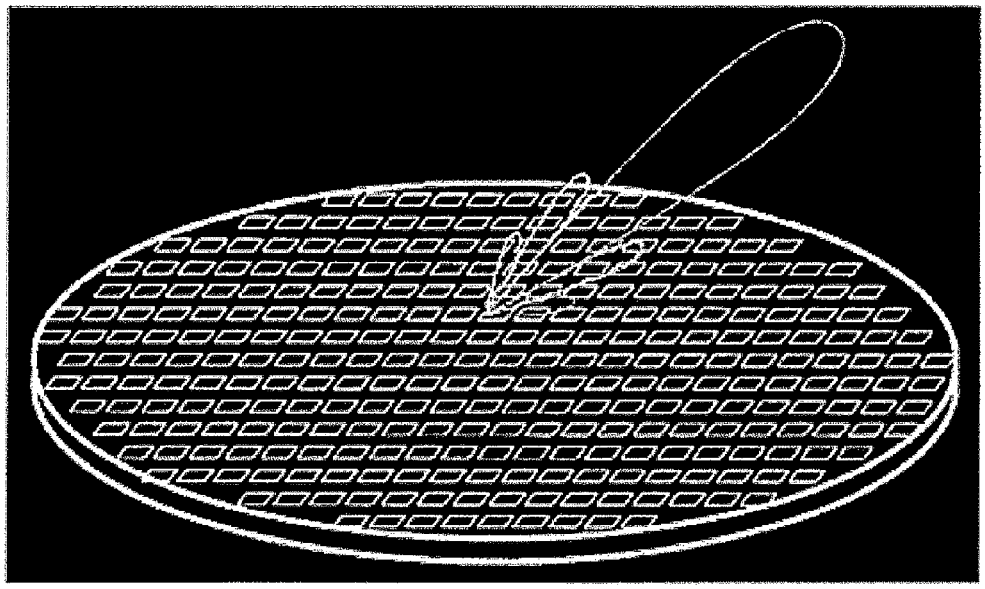
FIG. 4 illustrates an example of a directional beam transmission.

Using voltage amplitude triggered responses can also be used to help regulate timing. With reference to FIG. 3, the micro antennae or loops of antennae can be configured to transmit at different signal amplitude levels. The controller can send the signal variously to the transmission nodes so as to transmit in a phased timing.

The directionality of the body-worn phased array can be improved by accounting for and minimizing various transmission anomalies, e.g., unwanted transmission sidelobes. For example, the phased-array can be modeled—even across multiple body orientations (e.g., lying prone, running, kneeling, standing, etc.)—to account for constructive/deconstructive interference and high amplitude sidelobes. For example, EZNEC antenna software by W7EL, which is a front end to the NEC-2 and NEC-4 antenna modeling engines developed by Lawrence Livermore Lab, can be used to model array signal properties. Then, knowing the modeling of a particular configuration, the controller can use various techniques to maximize beam directionality and efficiencies, e.g., by minimize sidelobes. For example, the controller may apply digital phase shifters as discussed in Gotto et al.'s, "Sidelobe-Reduction Techniques for Phased Arrays Using Digital Phase Shifters," IEEE TRANSACTIONS ON ANTENNAS AND PROPAGATION, Vol. AP-18, NO. 6, November 1970, pgs. 769-773, which is hereby incorporated herein by reference. Different correction or different models may be used to approximate the current body position. Such models will also allow for accounting of the dielectric effect of the human body.

The controller can also account and compensate for different polarizations between the antennae that may be variously present as the orientation of the micro antennae change with body movement. (E.g., consider a leg as it bends to kneel. While kneeling, the antennae over that leg may include different polarizations based on leg positions, e.g., horizontal or vertical positions.) Knowing the relative positioning of the various micro antennae can help the controller account for differing polarization across the array.

The controller may also facilitate initial startup communication and reinitializing communication (e.g., if a dropped signal occurs). To initialize communication, the controller may issue a low level (even omni-directional) pilot signal. Key-based spread spectrum communications may to be used with the pilot signal. A receiving radio may handshake with the controller once a pilot signal is received, or the controller may lock onto a pilot signal of another radio.

If a signal is lost, the controller may default back to issuing an omni-directional pilot signal or may slowly broaden the directionality of a narrow beam until communications are reestablished.

The controller and radio discussed herein can include or cooperate with multiple sub-radios and sub-controllers arranged over the system. Processes can be assigned or divided between different controllers to improve signal and gain efficiencies.

For GHz and above frequencies, the degree of classic 'gain' that can be impressed into a reasonably narrow yet error-tolerant beam begins at the 20 dB (or 10× power gain) level and possibly even much better than that. Actual radio performance has and always will be a matter of testing and using, not theory.

The practical trade-off in this approach will be beam width (and its inherent gain—the narrower the beam the higher the gain) against precise knowledge and maintenance of where the beam should pointed. Too narrow of a beam, without the proper beam-locking mechanisms, and communications will unlikely occur. So there will be an inherent tension between gain and dynamic pointing, certainly once a cluttered non-line-of-sight environment enters the picture.

The controller can also cooperate with one or more nearby body phased arrays (e.g., worn by a nearby humans) to enhance transmission and reception of RF signals. Phased-timing between the two or more suits is controlled to have them operate as one larger phased array antenna.

Figure 5:
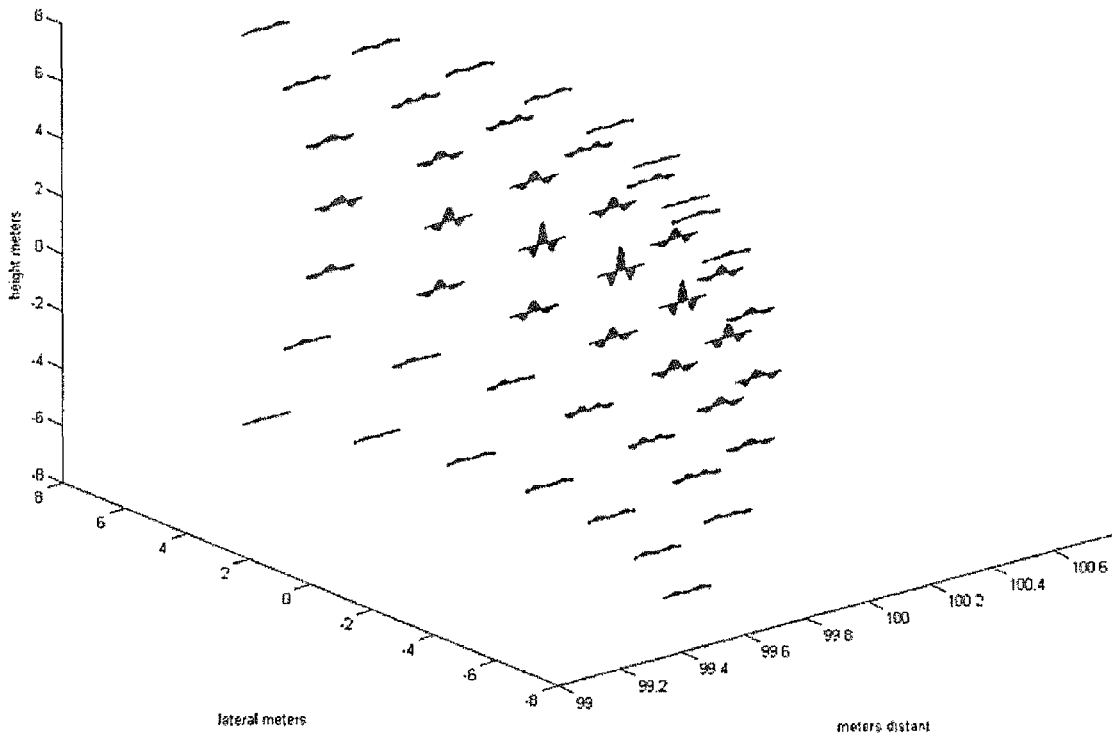
FIG. 5 illustrates a corresponding signal pattern to the FIGS phased-array system.

Appendix A includes MATLAB code that is used to model the phased array shown in FIG. 2. A corresponding signal pattern is shown in FIG. 5. (Of course, other signals waveforms could be used besides a dual-lobed wave.)

In alternative embodiments, metamaterial antennas are utilized for body-worn antenna systems. Metameterials and antenna using such materials are discussed, e.g., in U.S. Pat. Nos. 6,859,114; 6,958,729; 7,522,124; 7,538,946; 7,710,664; 7,764,232; 7,855,696; 7,872,812; 8,081,138; 8,164,837; 8,207,907; 8,384,600; 8,451,183; and 8,462,063, which are each hereby incorporated by reference in its entirety.

In some metamaterial antennas, one or more radio waves propagate along a surface of low-loss material comprising individual metamaterial elements. Each of those elements (or groups of elements) can be controlled to resonate or emit at a specific frequency and in specific directions. As the surface wave passes beneath the elements, waves of radiation emit from the surface at different angles depending on how each individual element (or groups of elements) is tuned. Constructive and destructive interference patterns can transmit in a desired direction and shape.

A body-worn uniform (e.g., clothing, suit, vest, helmet and/or jacket) is configured to include one or more metamaterial antenna. Such antenna preferably includes one or more array(s) of metamaterial elements arranged to be provided on or over a human body. Such elements (or groups of elements, or the arrays themselves) are controlled (e.g., with local or master suit controllers) to cooperatively emit waveforms. The elements (and/or arrays) can be controlled with timing signals to produce constructive and/or destructive interference patterns to facilitate directional communication.

In some implementations, transmission signals are locally generated under the control of timing signals coordinating the local firing of such transmission signals (or waveforms).

A controller can be used to account and compensate for different interference between the arrays of metamaterial elements that may be variously present as the orientation and location of the metamaterial antennae change with body movement.

```
boxlight—now cylinder—now loopy loopy loopy!!!
% create a random 3-D distribution of UWB emitters on the
    surface of a % body-dimension cylinder
% loopy: two ring loops per major limb bone, giving 8 rings
    on the arms % and legs; then belt loop, midriff, and just
    below the armpits; one loop % mid-shoulder and a final
    loop at the neck collar; total loops: 21!!! % perfect; how
    bout 12 antennae per loop a la the zodiac, 252 antennae
    % altogether; loopy perfect
% crudely model the body as one stick waist to collar, then
    two sticks each % for the four limbs. The body stick will
    have five loops, each limb-stick % will have two loops
    each; use various ellipse shapes as the loops % ellipse:
    x(t)=a cos(t) y(t)=b sin(t)
body_len=1.0; % meters
leg_len=0.5; % lower AND upper leg both
arm_len=0.6; % ditto, lower and upper
antennae_per_loop=12;
% lower left leg
stick_end=[0 0.15 0.1];
```

```
stick_vect=[0 0 leg_len];
forward=[1 0 0];
forward=forward/norm(forward);
crosss=cross(stick_vect,forward);
crosss=crosss/norm(crosss);
loops_per_stick=3;
ant_loc=zeros(4*loops_per_stick*antennae_per_loop,3);
cnt=0;
a=0.05; b=0.04;
for i=1:loops_per_stick
   cent=stick_end+(i−1)*stick_vect/(loops_per_stick−1);
   for t=1: antennae_per_loop
      cnt=cnt+1;
      tt=2*pi*(t/antennae_per_loop);
      ant_loc(cnt,:)=cent+a*cos(tt)*forward+b*sin(tt)*
         crosss;
   end
end
% lower right leg
stick_end=[0 −0.15 0.1];
stick_vect=[0 0 leg_len];
forward=[1 0.2 −0.1];
forward=forward/norm(forward);
crosss=cross(stick_vect,forward);
crosss=crosss/norm(crosss);
a=0.05; b=0.04;
for i=1:loops_per_stick
   cent=stick_end+(i−1)*stick_vect/(loops_per_stick−1);
   for t=1: antennae_per_loop
      cnt=cnt+1;
      tt=2*pi*(t/antennae_per_loop);
      ant_loc(cnt,:)=cent+a*cos(tt)*forward+b*sin(tt)*
         crosss;
   end
end
% upper left leg
stick_end=[0 −0.15 0.7];
stick_vect=[0 0 leg_len];
forward=[1 −0.25 −0.3];
forward=forward/norm(forward);
crosss=cross(stick_vect,forward);
crosss=crosss/norm(crosss);
a=0.07; b=0.05;
for i=1:loops_per_stick
   cent=stick_end+(i−1)*stick_vect/(loops_per_stick−1);
   for t=1: antennae_per_loop
      cnt=cnt+1;
      tt=2*pi*(t/antennae_per_loop);
      ant_loc(cnt,:)=cent+a*cos(tt)*forward+b*sin(tt)*
         crosss;
   end
end
% upper right leg
stick_end=[0 0.15 0.73];
stick_vect=[0 0 leg_len];
forward=[1 0.1 0.3];
forward=forward/norm(forward);
crosss=cross(stick_vect,forward);
crosss=crosss/norm(crosss);
a=0.07; b=0.05;
for i=1:loops_per_stick
   cent=stick_end+(i−1)*stick_vect/(loops_per_stick−1);
   for t=1: antennae_per_loop
      cnt=cnt+1;
      tt=2*pi*(t/antennae_per_loop);
      ant_loc(cnt,:)=cent+a*cos(tt)*forward+b*sin(tt)*
         crosss;
   end
end
% lower left arm
stick_end=[0.03 0.35 0.7];
stick_vect=[0 0 arm_len];
forward=[1 0.3 −0.3];
forward=forward/norm(forward);
crosss=cross(stick_vect,forward);
crosss=crosss/norm(crosss);
loops_per_stick=3;
a=0.04; b=0.03;
for i=1:loops_per_stick
   cent=stick_end+(i−1)*stick_vect/(loops_per_stick−1);
   for t=1: antennae_per_loop
      cnt=cnt+1;
      tt=2*pi*(t/antennae_per_loop);
      ant_loc(cnt,:)=cent+a*cos(tt)*forward+b*sin(tt)*
         crosss;
   end
end
% lower right arm
stick_end=[−0.02 −0.38 0.75];
stick_vect=[0 0 arm_len];
forward=[1 0.1 0];
forward=forward/norm(forward);
crosss=cross(stick_vect,forward);
crosss=crosss/norm(crosss);
loops_per_stick=3;
a=0.04; b=0.03;
for i=1:loops_per_stick
   cent=stick_end+(i−1)*stick_vect/(loops_per_stick−1);
   for t=1: antennae_per_loop
      cnt=cnt+1;
      tt=2*pi*(t/antennae_per_loop);
      ant_loc(cnt,:)=cent+a*cos(tt)*forward+b*sin(tt)*
         crosss;
   end
end
% upper left arm
stick_end=[0.05 0.36 1.4];
stick_vect=[0 0 arm_len];
forward=[1 0.2 −0.2];
forward=forward/norm(forward);
crosss=cross(stick_vect,forward);
crosss=crosss/norm(crosss);
loops_per_stick=3;
a=0.06; b=0.04;
for i=1:loops_per_stick
   cent=stick_end+(i−1)*stick_vect/(loops_per_stick−1);
   for t=1: antennae_per_loop
      cnt=cnt+1;
      tt=2*pi*(t/antennae_per_loop);
      ant_loc(cnt,:)=cent+a*cos(tt)*forward+b*sin(tt)
         *crosss;
   end
end
% upper right arm
stick_end=[0.01 −0.37 1.5];
stick_vect=[0 0 arm_len];
forward=[1 0.1 −0.2];
forward=forward/norm(forward);
crosss=cross(stick_vect,forward);
crosss=crosss/norm(crosss);
loops_per_stick=3;
a=0.06; b=0.04;
for i=1:loops_per_stick
   cent=stick_end+(i−1)*stick_vect/(loops_per_stick−1);
```

```
    for t=1: antennae_per_loop
        cnt=cnt+1;
        tt=2*pi*(t/antennae_per_loop);
        ant_loc(cnt,:)=cent+a*cos(tt)*forward+b*sin(tt)*
            crosss;
    end
end
% body waist through neck
stick_end=[0.01 −0.03 1.4];
stick_vect=[0 0 body_len];
forward=[1.1 −0.05];
forward=forward/norm(forward);
crosss=cross(stick_vect,forward);
crosss=crosss/norm(crosss);
loops_per_stick=6;
a=0.08; b=0.22;
for i=1:loops_per_stick
    cent=stick_end+(i−1)*stick_vect/(loops_per_stick−1);
    if i==5
        a=0.08;b=0.35;
    else if i==6
        a=0.04;b=0.04;
    end
    for t=1: antennae_per_loop
        cnt=cnt+1;
        tt=2*pi*(t/antennae_per_loop);
        ant_loc(cnt,:)=cent+a*cos(tt)*forward+b*sin(tt)*
            crosss;
    end
end
cyl_height=1.8; % meters
cyl_radius=0.3; % meters
num_uwbs=100;
%     uwb_location=(boxlength*rand(num_uwbs,3))−(box-
    length/2);
uwb_location=zeros(num_uwbs,3);
uwb_location(:,3)=cyl_height*rand(num_uwbs,1)−cyl_
    height/2;
din=2*pi*rand(num_uwbs,1);
uwb_location(:,1)=cyl_radius*sin(dirr);
uwb_location(:,2)=cyl_radius*cos(dirr);
wavelength=0.06; % in meters, 0.1 is roughly 3 GHz
waves=1.5; % one half-wave with 50% positive energy, and
    two with 25% energy
wave_lut=zeros(76,1); % simple lut on a sine wave
for i=1:76
    ii=i−1;
    amp=cos(2*pi*ii/100);
    if i<26
        wave_lut(i)=2*amp;
    else
        wave_lut(i)=amp;
    end
end
opt_dist=100;
optimized_pt=[opt_dist,0,0];
cyl_height_angle=180*a tan(cyl_height/opt_dist)/pi;
cyl_width_angle=180*a tan(2*cyl_radius/opt_dist)/pi;
% find light time between opt and all uwb_loc
% c=299792458;
advance_retard=zeros(num_uwbs,1);
for i=1:num_uwbs
    dist1=(uwb_location(i,1)−optimized_pt(1))^2;
    dist2=(uwb_location(i,2)−optimized_pt(2))^2;
    dist3=(uwb_location(i,3)−optimized_pt(3))^2;
    dist=sqrt(dist1+dist2+dist3);
    advance_retard(i)=dist−opt_dist;
end
% now produce the EM-field vector and intensity 'shell'
    about the opt_pt
% in tenth wavelength slices
shellslice=0.025; % meters
shellwidth=50;
theta_sampling=1.3; % degrees
theta_limit=3.9; % degrees
theta_dim=floor(2*(theta_limit/theta_sampling)+1);
field_val=zeros(shellwidth*2+1,theta_dim,theta_dim);
observation_pt=zeros(3,1);
tot_pts=(shellwidth*2+1)*theta_dim*thetadim;
obs_quiver_base=zeros(tot_pts,3);
obs_fieldvector=zeros(tot_pts,1);
dummy=zeros(tot_pts,1);
shellcount=0;
overall_count=0;
for dist_shell=−shellwidth:shellwidth
    shellcount=shellcount+1
    r=opt_dist+dist_shell*shellslice*wavelength;
    r2=r*r;
    ycount=0;
    for y=−theta_limit:theta_sampling:theta_limit
        ycount=ycount+1;
        observation_pt(2)=r*sin(pi*y/180);
        ob2=observation_pt(2)^2;
        zcount=0;
        for z=−theta_limit:theta_sampling:theta_limit
            zcount=zcount+1;
            overall_count=overall_count+1;
            observation_pt(3)=r*sin(pi*z/180);
            ob3=observation_pt(3)^2;
            observation_pt(1)=sqrt(r2−ob2−ob3);
            % what is the combined EM field & intensity at this
                observation
            totamp=0;
            for i=1:num_uwbs
                dist1=(uwb_location(i,1)−observation_pt(1))^2;
                dist2=(uwb_location(i,2)−observation_pt(2))^2;
                dist3=(uwb_location(i,3)−observation_pt(3))^2;
                dist=sqrt(dist1+dist2+dist3);
                amp=1/dist;
                wave_pt=floor(100*(dist-opt_dist-advance_retard
                    (i))/wavelength);
                if wave_pt>−76
                    if wave_pt<76
                    if wave_pt<0
                    wave_pt=−wave_pt;
                    end
                    wave_pt=wave_pt+1;
                    totamp=totamp+amp*wave_lut(wave_pt);
                    end
                end
            end
            field_val(shellcount,ycount,zcount)=totamp;
            obs_fieldvector(overall_count)=totamp;
            obs_quiver_base(overall_count,1)=observation_pt
                (1);
            obs_quiver_base(overall_count,2)=observation_pt
                (2);
            obs_quiver_base(overall_count,3)=observation_pt
                (3);
        end
    end
end
foo=zeros(theta_dim);
foo(:,:)=field_val((shellcount+1)/2,:,:);
```

```
imagesc(foo);
% quiver3(obs_quiver_base(:,1),obs_quiver_base(:,2),obs_quiver_base(:,3), . . .
% dummy,dummy,obs_fieldvector,2,'ShowArrowHead', 'off','Marker','.');
quiver3(obs_quiver_base(:,1),obs_quiver_base(:,2),obs_quiver_base(:,3), . . .
dummy,dummy,obs_fieldvector,3,'ShowArrowHead','off');
axis([99 101 -8 8 -8 8]);
grid off
xlabel('meters distant');
ylabel('lateral meters');
zlabel('height meters');
```

CONCLUDING REMARKS

Having described and illustrated the principles of the technology with reference to specific implementations, it will be recognized that the technology can be implemented in many other, different, forms. To provide a comprehensive disclosure without unduly lengthening the specification, applicants incorporate by reference the patents and documents referenced above.

The methods, processes, and systems described above may be implemented in hardware, software or a combination of hardware and software. The particular combinations of elements and features in the above-detailed embodiments are exemplary only; combinations between the different implementations and embodiments is expressly considered; the interchanging and substitution of these teachings with other teachings in this and the incorporated-by-reference patents/documents are also contemplated.

What is claimed is:

1. A radio wearable by a human comprising:

a phased-array antenna including a plurality of antennae, the phased-array antenna configured for wearing over or on a human body, the plurality of antennae provided for spatially positioning in multiple different regions over or on the human body;

a radio-frequency (RF) radio; and a controller configured for: i) determining relative spatial position information for antennae within the phased-array antenna; and ii) using at least the relative spatial position information, controlling the RF radio to produce a directional ultra-wide band (UWB) beam through the phased-array antenna.

2. The radio of claim 1 further comprising a delay circuit, in which the controller utilizes the delay circuit to communicate RF signals to different antennae within the phased-array antenna.

3. The radio of claim 1 further comprising a delay circuit, in which the controller utilizes the delay circuit to control phase timing within the phased-array antenna.

4. The radio of claim 1 in which the controller utilizes transmission delays in combination with the relative spatial position information—or delay information derived therefrom—to control the radio to produce a directional UWB beam through the phased-array antenna.

5. The radio of claim 1 in which the controller determines the relative spatial position information based on a clue.

6. The radio of claim 5 in which the clue comprises a predetermined time.

7. The radio of claim 5 in which the clue comprises gyroscope information or acceleration information.

8. Clothing comprising the radio of claim 1 integrated therein.

9. A system comprising:

a first plurality of antennae configured for wearing over or on a first human body, the first plurality of antennae provided for spatially positioning in multiple different regions over or on the first human body;

a second plurality of antennae configured for wearing over or on a second human body, the second plurality of antennae provided for spatially positioning in multiple different regions over or on the second human body;

one or more controllers configured for: i) determining relative spatial position information for antennae associated with the first plurality of antennae; ii) determining relative spatial position information for antennae associated with the second plurality of antennae; and iii) controlling phase distribution of signals across the first plurality of antennae and the second plurality of antennae to produce directional ultra-wide band (UWB) beams as if through a phased-array antenna.

10. A radio wearable by a human comprising:

an antenna including a plurality of metamaterial elements, the antenna configured for wearing over or on a human body, the plurality of metamaterial elements provided for spatially positioning in multiple different regions over or on the human body;

a radio-frequency (RF) radio; and a controller configured for controlling the production of constructive or destructive interference patterns generated by the plurality of metamaterial elements for signal transmission.

11. The radio of claim 10 in which the controller is configured to determine a relative spatial position of the metamaterial elements.

12. The radio of claim 11 in which the relative spatial position of the metamaterial elements is determined based on a clue.

13. The radio of claim 12 in which the clue comprises a predetermined signal propagation time.

14. The radio of claim 12 in which the clue comprises gyroscope information or acceleration information.

15. The radio of claim 10 in which the controller is configured for controlling the production of constructive or destructive interference patterns generated by the plurality of metamaterial elements for signal transmission in a desired direction and shape.

16. The radio of claim 1 in which the controller comprises integrated circuitry.

17. The radio of claim 1 in which the controller comprises plural microprocessors.

18. The radio of claim 1 in which the controller comprises a digital signal processor.

19. A system comprising:

a phased-array antenna including a plurality of antennae, the phased-array antenna provided for dynamic spatially positioning in multiple different configurations;

a radio-frequency (RF) radio;

means for determining relative spatial position information for antennae within the phased-array antenna, in which said means for determining determines the relative spatial position information based on a clue, in which the clue comprises gyroscope information or acceleration information; and means for controlling the RF radio to produce a directional ultra-wide band (UWB) beam through the phased-array antenna using at least the relative spatial position information.

20. Clothing wearable by a human comprising the system of claim 19, in which the phased-array antenna is configured for wearing over or on a human body so as to cover multiple different regions of the body.

21. The system of claim 19 further comprising a delay circuit, in which said means for controlling utilizes the delay circuit to communicate RF signals to different antennae within the phased-array antenna.

22. The system of claim 19 further comprising a delay circuit, in which said means for controlling utilizes the delay circuit to control phase timing within the phased-array.

23. The system of claim 19 in which said means for controlling utilizes transmission delays in combination with the relative spatial position information—or delay information derived therefrom—to control the RF radio to produce a directional UWB beam through the phased-array antenna.

24. A method comprising:

providing a first uniform or first clothing having a first plurality of antennae, the first uniform or first clothing to be worn over or on a first human body, in which the first plurality of antennae are spatially positioned in multiple different regions of the first uniform or first clothing;

providing a second uniform or second clothing having a second plurality of antennae, the second uniform or second clothing to be worn over or on a second human body, in which the second plurality of antennae are spatially positioned in multiple different regions of the second uniform or second clothing;

establishing relative spatial position information for antennae associated with the first plurality of antennae;

establishing relative spatial position information for antennae associated with the second plurality of antennae; and producing a directional ultra-wide band (UWB) beam as if through a phased-array antenna by controlling phase distribution of signals across the first plurality of antennae and the second plurality of antennae.

* * * * *